US006901855B2

(12) United States Patent
Sauer et al.

(10) Patent No.: US 6,901,855 B2
(45) Date of Patent: Jun. 7, 2005

(54) DEVICE FOR SEPARATING USEFUL UNITS OF A PRINTED SHEET

(75) Inventors: Hartmut Karl Sauer, Himmelstadt (DE); Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 52 days.

(21) Appl. No.: 10/433,483

(22) PCT Filed: Nov. 12, 2001

(86) PCT No.: PCT/DE01/04246

§ 371 (c)(1),
(2), (4) Date: Jun. 13, 2003

(87) PCT Pub. No.: WO02/48014

PCT Pub. Date: Jun. 20, 2002

(65) Prior Publication Data

US 2004/0020384 A1 Feb. 5, 2004

(30) Foreign Application Priority Data

Dec. 15, 2000 (DE) ..... 100 62 817

(51) Int. Cl.[7] ..... B41F 13/56; B65H 33/14; B65H 43/04; B65H 29/62

(52) U.S. Cl. ..... 101/227; 101/226; 101/484; 270/52.09

(58) Field of Search ..... 101/72, 76, 219, 101/226, 227, 232, 240, 481, 483, 484, 485, 486; 270/1.03, 52.04, 52.09, 52.17

(56) References Cited

U.S. PATENT DOCUMENTS

| | | | | |
|---|---|---|---|---|
| 4,633,395 | A | 12/1986 | Kuehfuss | 364/403 |
| 4,793,251 | A | 12/1988 | Kuehfuss | 101/93.01 |
| 4,843,959 | A | 7/1989 | Rendell | 101/301 |
| 5,628,574 | A | 5/1997 | Crowley | 400/621 |
| 6,646,280 | B1 * | 11/2003 | Schaede | 250/559.01 |
| 6,684,787 | B1 * | 2/2004 | Sauer | 101/484 |

FOREIGN PATENT DOCUMENTS

| | | |
|---|---|---|
| DE | 199 39 164 A1 | 3/2001 |
| DE | 100 02 904 A1 | 8/2001 |
| EP | 0 248 307 A1 | 12/1987 |
| EP | 0 286 317 A1 | 10/1988 |
| FR | 2 656 290 | 6/1991 |
| GB | 1 557 264 | 12/1976 |

* cited by examiner

*Primary Examiner*—Leslie J. Evanisko
(74) *Attorney, Agent, or Firm*—Jones, Tullar & Cooper PC

(57) ABSTRACT

Faulty useful units printed on a sheet of useful units are separated from the acceptable useful units. A first cutting device cuts the sheet into a plurality of longitudinal strips, each of which contains several of the useful units. A quality control device detects the faulty useful units prior to a second cutting device that cuts the strips into individual units. A filtering unit is placed between the two cutting units and filters out strips with one or more faulty units. Strips with no faulty units replace the filtered out faulty unit strips. This simplifies further processing of the strips.

13 Claims, 2 Drawing Sheets

DEVICE FOR SEPARATING USEFUL UNITS OF A PRINTED SHEET

FIELD OF THE INVENTION

The present invention is directed to a device and to a method for separating single usable imprints printed in groups on a printed sheet. Defective usable imprints are removed and are replaced by replacement usable imprints.

BACKGROUND OF THE INVENTION

A generally known prior art device and method are known from EP 0 248 307 A1.

This generally known prior art device is employed for detecting those specific imprints, whose printing shows faults, on a sheet on which a plurality of these imprints, typically of security papers, and, in particular, banknotes, have been imprinted. The device of the prior art is also used for cutting the sheet into individual usable imprints, for extracting the faulty ones and for consecutively numbering those imprints without faults. For this purpose, this prior art device includes a first cutting device for cutting the sheet into a plurality of strips each containing several usable imprints, a quality control arrangement for detecting faulty imprints, and a second cutting device for cutting the strips into individual usable imprints. The strips are conducted through a numbering device, which is controlled on the basis of information regarding the position of the faulty imprints received from the previous quality control arrangement. A faulty imprint on a strip remains unnumbered. Thereafter, the strips are cut into individual usable imprints, and the faulty ones are extracted.

Later published DE 199 39 164 A1 discloses a method for processing imprinted materials, wherein the printed image containing a plurality of usable imprints is checked. The imprinted material is separated into individual usable imprints and faulty imprints are extracted.

EP 0 286 317 A1 shows a device for cutting a web into sheets. These sheets are deposited on different stacks as a function of their quality as determined by a control device.

SUMMARY OF THE INVENTION

The object of the present invention is directed to providing a method and a device for separating usable imprints on an imprinted sheet.

In accordance with the present invention, the object is attained by providing a device for conveying adjacently located strips of useful imprints. The device includes first and second conveying units. A shunt for extracting strips and an inserting device for inserting replacement strips are located intermediate the two spaced conveying devices. Faulty imprints on the sheet are detected. The sheet is then cut into a plurality of strips. Each strip that includes a faulty imprint is extracted. The place of the extracted faulty strip is taken by a replacement strip which is fault-free.

The advantages obtained by the present invention lie, in particular, in that the control of the method, or of the device, is considerably simplified. Because the strips containing faulty imprints are extracted prior to each strip being separated into individual imprints, it is not necessary to store information regarding the position of the faulty imprint or imprints on a sheet or strip. This also need not be taken into consideration in the course of further processing of the individual usable imprints.

In a first preferred embodiment of the present invention, a sheet which is provided with a plurality of imprints is first cut into strips transversely to the conveying direction of the sheet by a first cutting device. If, in this case, it is necessary to remove a strip because of a fault, the gap caused by this strip removal can be closed, in a simple way, by letting additional strips of a following sheet catch up and by adding an additional strip of the following sheet in order to complete, in this way, the number of strips customarily obtained from a sheet. In this way, a regular sequence of fault-free strips is obtained, which strips can be further processed, for example by being numbered, separated and banded with little management effort.

In a second preferred embodiment of the present invention, a sheet is cut into strips longitudinally with respect to its conveying direction. If one of these strips is faulty and is extracted, it is useful to replace the removed strip by adding a replacement strip from a magazine of strips and to insert the replacement strip in place of the extracted strip. The group of strips obtained in this way can also be further processed with little management effort.

To make the extraction of faulty strips, as well as their subsequent processing, easier, it is beneficial if the strips cut from a sheet are spaced apart transversely to the cutting direction.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
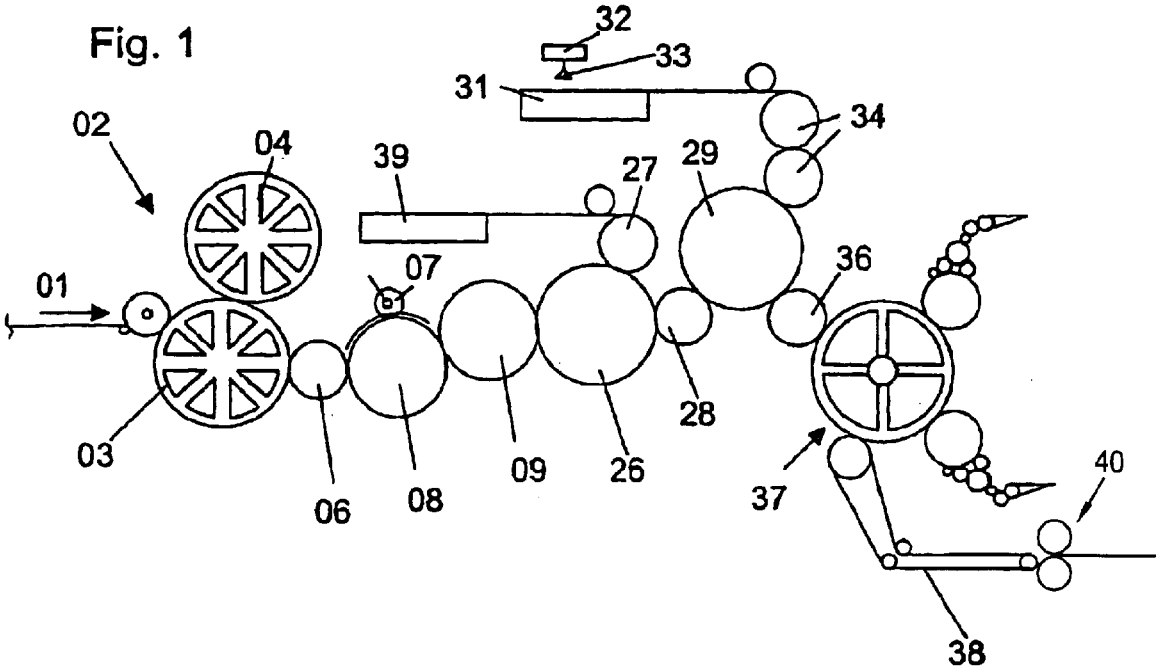
FIG. 1, a schematic side elevation view of a device which can be used in an arrangement for separating, banding and packaging freshly printed banknotes, in FIG. 2, a side elevation view, in detail, of a plurality of the rollers depicted in FIG. 1, in FIG. 3, a perspective view of a preferred embodiment of a suction device of a roller, in FIGS. 4*a*, 4*b*, cross-sectional views through the surface area of a transfer cylinder in accordance with a further embodiment of the present invention and in, FIG. 5, a schematic representation of a second preferred embodiment of the present device.

A first preferred embodiment of a device in accordance with the present invention is represented in a schematic side elevation view in FIG. 1. Sheets, on which banknotes are imprinted in a line and column arrangement, are fed to the device from a sheet feeder, which is not specifically represented, in a conveying direction 01, i.e. in the direction of arrow 01. First, the sheet passes through a quality control unit 02. This quality control unit 02 comprises two control cylinders 03, 04. The structure of the two control cylinders 03, 04 is substantially identical. Their surface areas each have large-sized cutouts, by which each fed-in sheet is held in such a way that the previously produced imprints, such as in this case individual banknotes, are visible to a CCD camera that is housed in the interior of the control cylinder 03, 04, and which is not specifically shown in FIG. 1. An evaluating unit is connected to the CCD camera, which evaluating unit is equipped for detecting faults in the printed image of the individual banknotes. The sheets pass through a gap between the two control cylinders 03, 04, so that the CCD cameras in the two control cylinders 03, 04 are able to check the front and back of each sheet and to record information regarding the position of possibly faulty imprints on each sheet.

A cutting device 06, which is used for cutting the sheet into a plurality of strips, is arranged downstream or following the quality control unit 02 in the sheet conveying direction 01. In the first preferred embodiment depicted in FIG. 1, this sheet cutting device 06 is a longitudinal cutting device 06, which separates each sheet into longitudinal strips by the formation of cuts made in the sheet and extending parallel with respect to the conveying direction. Each one of these longitudinal strips corresponds to a column of the line and column arrangement of the imprints on the original sheet. In a generally known manner, the longitudinal cutting device 06 is formed using a roller 08, on which the sheet is held and guided and which roller 08 has a plurality of circumferential grooves on its surface area, and a cooperating arrangement of circular cutters 07, which cutters 07 rotate around a common axis and act, together with the grooves, for cutting the sheet into the individual strips and for cutting off the lateral edges. The cut-off lateral edges are removed, for example by being sucked away. The now formed strips are transferred to a conveying element 09, in the form of, for example, a transfer cylinder 09.

Figure 3:
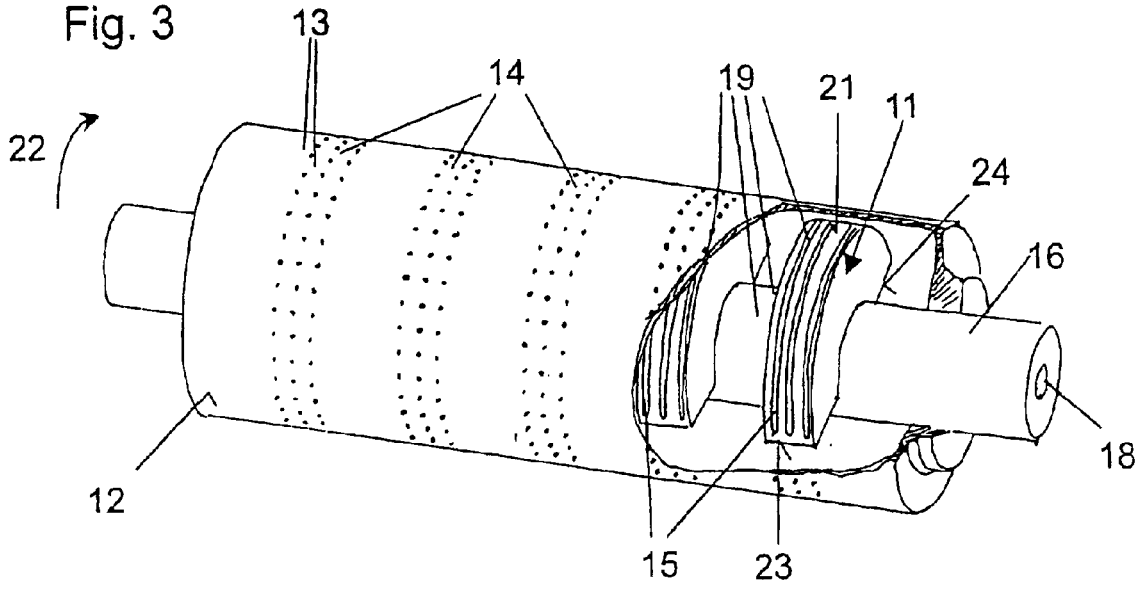

In order to be able to grasp and to convey the several adjacently located strips issuing from the longitudinal cutting device 06, the transfer cylinder 09 is equipped with an internal suction device 11 which, as represented in greater detail in FIG. 3, includes a plurality of holes 13 punched into a surface area 12 of the transfer cylinder 09. Transfer cylinder 09 is thus capable of aspirating every individual strip and of maintaining it on a limited portion of the circumference of the transfer cylinder 09, firmly pressed against the latter.

FIG. 3 shows the transfer cylinder 09 partially cut open, so that a suction device 11 in its interior can be seen. The holes 13 in the surface area 12 of transfer cylinder 09 are grouped in rows on several circumferential bands 14, wherein the number of these bands 14 and their axial spacing distance from each other corresponds to the number of strips delivered from the longitudinal cutting device 06 and to the width of these strips. Several suction elements 15, in the form of suction chambers 15, each in the shape of sectors of a circle, are arranged on the interior of the surface area 12 of transfer cylinder 09 and are situated on a shaft 16. The shaft 16, and the suction chambers 15 on it, are fixed in place, while the surface area 12 of transfer cylinder 09 rotates. The suction chambers 15 are connected to a suction pump, which is not specifically represented, by a suction line 18 that is conducted through the shaft 16. Arcuately extending slits 19 are arranged on exterior walls 21 of the various suction chambers 15 in such a way that, in the course of the rotation of the surface area 12, one axially extending row of holes 13 at a time moves ahead of a slit 19. If the surface area 12 of the transfer cylinder 09 rotates in the direction of the arrow 22 in FIG. 3, a front edge 23 of each of the suction chambers 15 facing the observer corresponds to the location where the strips are each aspirated by the transfer cylinder 09 in order to be conveyed by the latter in the direction of the arrow 22, and the rear edge 24 of each of the suction chambers 15, facing away from the observer, is the location where the suction effect on the strips ends and they can be removed from the surface area 12 of transfer cylinder 09.

The transfer cylinder 09 transfers the strips, which are conducted parallel in respect to each other, to a cylinder 26, hereinafter called a removal cylinder 26, whose structure also substantially corresponds to the structure of the transfer cylinder represented in FIG. 3. However, a difference in the removal cylinder 26, with respect to the transfer cylinder 09, can lie in that each chamber 15 of the removal cylinder 26 can be equipped with a valve in order to selectively interrupt the vacuum supply to individual chambers 15, to thereby operate the suction chambers 15 of the removal cylinder 26 independently of each other.

Figure 2:
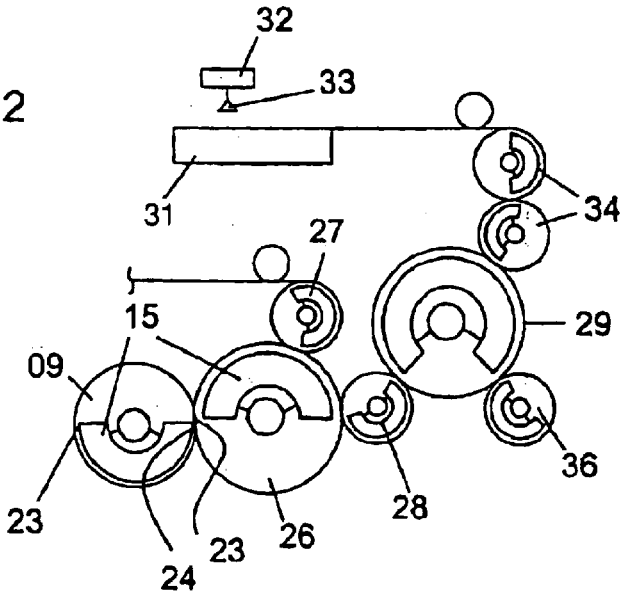

FIG. 2 shows the first transfer cylinder 09, the removal cylinder 26 and a plurality of downstream connected cylinders, each with the suction devices 11, including the suction chambers 15, arranged in their interiors. The rear edges 24 of the suction chambers 15 of the suction device 11 of the transfer cylinder 09 are located generally aligned with the front edge 23 of the suction chambers 15 of the suction device 11 of the removal cylinder 26 and opposite to a gap formed between the transfer cylinder 09 and the removal cylinder 26. In the course of the transfer of the strips from the transfer cylinder 09 to the removal cylinder 26, the suction effect of the transfer cylinder 09 stops at the moment at which the suction effect of the removal cylinder 26, starts.

The removal cylinder 26 rotates in contact with two subsequent transfer or delivery cylinders 27, 28, which are each also equipped with an internal suction device 11. In the normal state, the suction device 11 of the faulty strip delivery cylinder 27 is inactive, and it is equipped with a valve for the selective charging of individual chambers 15 with a source of vacuum or suction. If a fault in an imprint on a sheet has been detected in the quality control unit 02, the column of the sheet on which this imprint is located is recorded. As soon as the strips of the sheet reach the faulty strip delivery cylinder 27, the chamber 15 of the faulty strip delivery cylinder 27 corresponding to this column is charged with a vacuum in order to pull the faulty strip off the surface of the removal cylinder 26. Pulling the faulty strip off the surface of the removal cylinder 26 can be made easier in that the vacuum supply to the corresponding suction chamber 15 of the suction device 11 of the removal cylinder 26 is interrupted, provided the suction chambers 15 of the latter are equipped with valves.

All strips in which the quality control unit 02 did not detect a fault pass through the gap between the removal cylinder 26 and the first, faulty strip delivery cylinder 27 unhampered and remain attached to the removal cylinder 26 until, at the level of a gap to the second delivery cylinder 28, they reach the end of the suction chamber 15 of the removal cylinder 26. However, as represented in FIG. 3, the chamber 15 of the suction device 11 of the second accepted strip delivery cylinder 28 starts at the level of this gap. Thus the strips which reach this gap are released from the surface of the removal cylinder 26 and make a transition into the second accepted strip delivery cylinder 28.

In this way the removal cylinder 26, together with the first and second delivery cylinders 27, 28, constitutes a shunt, where, in accordance with their quality, the strips are fed either to a waste depository 39, or on to further processing.

The waste depository 39 is divided into a plurality of compartments which are located adjacent each other transversely or axially in relation to the cylinders shown in FIG. 2, and whose number and arrangement corresponds to the distribution of the bands on the removal cylinder 26. In this way, every extracted strip can be brought by simple parallel conveyance to a compartment in the waste depository 39 corresponding to the column in the original sheet from which the strip was cut. If a malfunction of the printing press on which the sheets to be processed are imprinted leads to a local uneven distribution of faults on the sheets, this can be immediately detected by counting of the different number of strips which accumulate in the individual compartments of the waste depository 39.

The second, accepted strip delivery cylinder 28 transports the accepted or fault-free strips on to a so-called collecting cylinder 29, which is used to replenish the extracted faulty strips by fault-free ones. A magazine 31 is arranged at the collecting cylinder 29, and can be equipped with fault-free replacement strips in a plurality of compartments, which are located one behind the other. A distributing device 32 has a suction head 33, which can be moved vertically in respect to each one of the compartments and in the longitudinal direction of the strips, and by use of which an individual replacement strip can be removed from a compartment. Removed replacement strips are routed to the collecting cylinder 29 over several rollers 34. The operation of the distributing device 32 is linked with that of the removal cylinder 26, or the one of the first, faulty strip delivery cylinder 27 in such a way that every time a faulty strip is extracted, a replacement strip is taken from the compartment of the magazine 31 corresponding to the same column and is conveyed to the collecting cylinder 29, synchronized in such a way, that the front edges of the non-extracted accepted or fault-free strips of the original sheet and of the newly inserted replacement strip lie on a common line on the collecting cylinder 29. Therefore the arrangement of strips which subsequently are passed on by the collecting cylinder 29 to a further conveying element, for example a second transfer cylinder 36, can no longer be distinguished from an arrangement which would have been obtained by merely cutting a fault-free sheet into strips.

The individual usable imprints on this now formed arrangement of strips can be sequentially numbered in a simple manner and without a large control effort on a numbering unit 37 following the second transfer cylinder 36, in particular without the need of having to take misprints possibly occurring on the strips into account.

A conveyor belt device 38 conveys the strips with the sequentially numbered usable imprints to a second cutting device, which is represented schematically at 40 in FIG. 1, and which is typically a transverse cutting device, in which the usable imprints on the individual strips are separated. No extraction of faulty imprints, after the separation of the strips into individual usable imprints, is required any longer, since these faulty imprints have already been removed at the removal cylinder 26. Therefore, the usable imprints obtained can be collected, banded, or packaged in the manner customary for banknotes without a further check and/or sorting step.

Figure 4A:
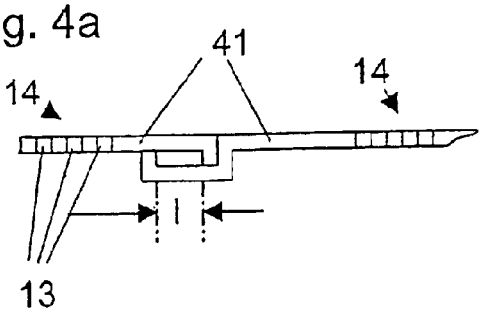
Figure 4B:
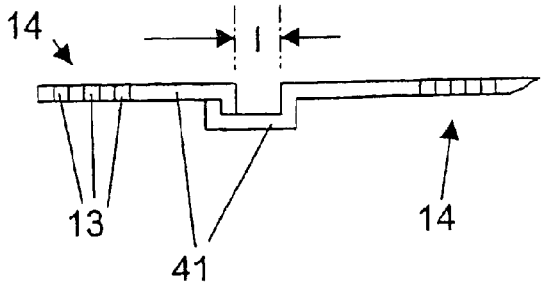

FIGS. 4*a* and 4*b* show a section through the surface area 12 of a first transfer cylinder 09 in accordance with a further embodiment of the devices shown in FIGS. 1 to 3. In this embodiment, the surface area 12 is constructed from a plurality of segments 41, wherein one of the bands 14 of holes 13 is formed in each segment 41. The segments 41, which are axially displaceable in respect to each other, are in engagement with each other. FIG. 4*a* shows two segments 41 in a pushed-together or compressed position, which position corresponds to the least possible distance l between adjacent bands 14, and which position is taken up by the segments 41 at the time of taking over strips from the longitudinal cutting device 06. In the course of the rotation of the first transfer cylinder 09, the segments 41, controlled by, for example a cam disk, are continuously moved away from each other until they reach the expanded position shown in FIG. 4*b*, which expanded position corresponds to the greatest possible distance l between the bands 14. This is the position in which the first transfer cylinder 09 is at the time of the transfer of the strips to the removal cylinder 26. Therefore, the strips are transferred to the removal cylinder 26 at a distance l from each other which corresponds to the displaceability l of the segments 41 in respect to each other. The displacement of the segments 41 by this l insures that the extraction of a faulty strip at the removal cylinder .26 is not hampered by its being hooked to the adjoining strip. The axial distancing of the individual strips achieved in this way is also advantageous, because by this, the further processing of the strips, following the extraction of the faulty ones, such as separation and possibly banding, is simplified.

The surface area segments 41 are subsequently again pushed together, following the transfer of the strips to the removal cylinder 26, so that they are again in the configuration in accordance with FIG. 4*a* during the transfer of a subsequent group of strips from the longitudinal cutting device 06.

In this first embodiment of the present invention, the suction chambers 15 of the suction device 11 of the transfer cylinder 09 are axially displaceable in respect to each other, and are coordinated to the movement of the segments 41 in respect to each other, so that the alignment of the rows of holes 13 with the slits 19, which is important for the suction effect, always remains.

If the distance l along the circumference of the second transfer cylinder 36 from the gap between the first transfer cylinder 09 and the removal cylinder 26, on the one hand, to the gap between the removal cylinder 26 and the first faulty strip delivery cylinder 27, on the other hand, is set to be greater than the length of the strips, it is possible to synchronize the movement of the segments 41 away from each other with the rotation of the removal cylinder 26 in such a way, that this movement of the segments takes place entirely during the time in which the strips are located between the two gaps. Tilting or skewing of the strips on the removal cylinder 26 is avoided in this way.

Figure 5:
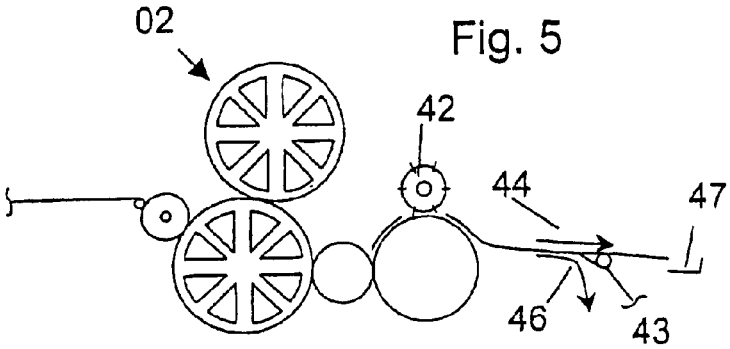

FIG. 5 shows a schematic side elevation view of a second preferred embodiment of the present invention. The quality control unit 02 here is identical to the one described in connection with FIG. 1. However, a transverse cutting device 42 is provided in this second embodiment as the cutting device following the quality control unit 02. The sheets are each cut into transverse strips by this transverse cutting device 42 in accordance with the lines of the line and column pattern of the usable imprints placed thereon. A shunt 43, which is arranged following the transverse cutting device 42, is switched back and forth as a function of the results obtained from the quality control unit 02 and obtained at the transverse cutting device 42. Fault-free strips are conducted to further processing, as indicated by arrow 44, and faulty ones are discarded, as indicated by arrow 46. As indicated in FIG. 5, the shunt 43 can be embodied as a pivotable flap. However, an embodiment similar to the shunt composed of the cylinders 26, 27, 28 in FIG. 1 is also usable. Further processing downstream of the shunt 43 can be such that the transverse strips are conveyed on to a numbering unit 37 with the aid of grips guided on lateral chains in the same cycle time in which they were delivered by the transverse cutting device 42. If a transverse strip is missing in the numbering unit because it had been previously extracted, the numbers to be printed in the numbering unit are not advanced. The numbers with which a fault-free sheet would have been imprinted on its last strip, are imprinted on the first strip of the succeeding sheet. As indicated in FIG. 5, it is also within the scope of the present invention to initially collect a preset number of fault-free strips at a feeder 47 which is arranged downstream of the shunt 43, and then to further process the stack obtained in this manner.

In both of the two preferred embodiments described above, it is possible, in a simple manner, to further process the strips obtained after the faulty strips have been extracted and, in the case of the first embodiment, following their replacement by fault-free strips, without a special treatment being necessary for individual strips or for individual usable imprints. A considerable simplification of the necessary control assembly results from this. If no sequential numbering of the usable imprints obtained is necessary, the first embodiment can also be simplified by leaving out the collecting cylinder 29 and the magazine connected therewith, in this case, the strips are passed on directly from the delivery cylinder 28 to the second cutting device without filling possible gaps.

The device for transporting adjacently located strips, in accordance with the present invention, has a first conveying element or transfer cylinder 09 and a second conveying element or transfer cylinder 36, wherein a shunt 26, 27, 28, or 43 for extracting strips and an inserting device 29, 31, 32, 33 for inserting a replacement strip at the position of an extracted strip are arranged between the two conveying elements 09, 36. The shunt 26, 27, 28, or 43 is arranged between a first cutting device 06, or 42 and a second cuffing device. Moreover, an inserting device 29, 31, 32, 33 for inserting a replacement strip in place of an extracted faulty strip is provided between the first cutting device 06 or 42 and the second downstream cutting device.

While preferred embodiments of a device and method for separating useful units of a printed sheet in accordance with the present invention have been set forth fully and completely hereinabove, it will be apparent to one of skill in the art that various changes in, for example, the type of press used to print the sheets, the specific nature of the useful units on the sheets and the like could be made without departing from the true spirit and scope of the present invention which is accordingly to be limited only by the following claims.

What is claimed is:

1. A device for conveying a plurality of strips comprising:

a first conveying element;

a second conveying element located after, in a direction of strip conveyance, said first conveying element;

a shunt adapted to extract a strip;

an inserting device adapted to insert a replacement strip in the position of an extracted strip, said shunt and said inserting device being located between said first conveying element and said second conveying element; and first and second strip cutting devices, said shunt and said inserting device being located between said first and second strip cutting devices.

2. The device of claim 1 wherein said first strip cutting device is a transverse cutting device.

3. The device of claim 1 wherein said first strip cutting device is a longitudinal cutting device.

4. The device of claim 1 further including a waste depository adapted to receive strips from said shunt, said waste depository being located after said shunt.

5. The device of claim 1 wherein said first conveying element is located between said shunt and said first cutting device.

6. The device of claim 5 wherein said first conveying element includes a transfer cylinder having a plurality of axially shiftable strip aspirating segments.

7. The device of claim 6 wherein said transfer cylinder includes a strip take-over gap and a strip release gap with a distance between said take-over gap and said release gap being greater than a strip length.

8. The device of claim 1 wherein said shunt includes a plurality of independently actable suction elements, each of which acts on a strip.

9. The device of claim 1 wherein said inserting device includes a magazine.

10. The device of claim 9 wherein said inserting device has a plurality of independently actable movable suction heads which act on said magazine.

11. The device of claim 1 further including a strip numbering unit.

12. The device of claim 11 wherein said strip numbering unit is arranged between said first and second cutting devices.

13. The device of claim 12 wherein said strip numbering unit is located after said inserting device.

* * * * *